United States Patent [19]

Ikebuchi et al.

[11] Patent Number: 4,872,973

[45] Date of Patent: Oct. 10, 1989

[54] CYCLONE CLASSIFIER

[75] Inventors: Iwao Ikebuchi, Hirakata; Mamoru Nakano, Kadoma; Kazuo Fuse, Nara; Akira Ganze, Tokyo, all of Japan

[73] Assignee: Kubota Ltd., Osaka, Japan

[21] Appl. No.: 315,237

[22] Filed: Feb. 23, 1989

Related U.S. Application Data

[63] Continuation of Ser. No. 51,373, May 19, 1987, abandoned.

[30] Foreign Application Priority Data

Apr. 6, 1987 [JP] Japan ..... 62-51883[U]

[51] Int. Cl.[4] ..... B04C 3/00

[52] U.S. Cl. ..... 209/144; 209/154; 209/211

[58] Field of Search ..... 209/144, 211, 145, 154

[56] References Cited

U.S. PATENT DOCUMENTS

| | | | |
|---|---|---|---|
| 2,829,771 | 4/1958 | Dahlstrom | 209/211 |
| 3,425,545 | 2/1969 | Zemanek et al. | 209/211 |
| 3,642,129 | 2/1972 | McDaniel et al. | 209/211 |
| 3,687,286 | 8/1972 | Weiss | 209/211 |
| 4,600,410 | 7/1986 | Baille et al. | 209/144 |
| 4,696,737 | 9/1987 | Bouchillon | 209/211 |

FOREIGN PATENT DOCUMENTS

| | | | |
|---|---|---|---|
| 979284 | 1/1948 | France | 209/211 |
| 476833 | 8/1967 | Japan | 209/144 |
| 1002035 | 3/1983 | U.S.S.R. | 209/211 |
| 8606653 | 11/1986 | World Int. Prop. O. | 209/211 |

*Primary Examiner*—Robert B. Reeves
*Assistant Examiner*—Donald T. Hajec
*Attorney, Agent, or Firm*—Wenderoth, Lind & Ponack

[57] ABSTRACT

In a cyclone classifier wherein the material to be processed is swirled in a tubular casing having a conical lower portion and classified, a cylindrical body is provided in the casing, so as to surround the lower end of a fluid outlet pipe and extends downwardly below an inlet port for the material to be processed, so that the sectional area of passage for the material to be processed swirled in the casing will be made smaller, thus increasing the classifying point while keeping the pressure loss at a minimum. From another aspect, annular pipes formed with fluid inlet ports are provided around the outer periphery of a lower part of the casing so as to communicate with the casing so that gases or liquids will be blown into the lower part of the casing through these pipes to form a swirling current, thus allowing the material to be processed to be reclassified thereby increasing the classifying point.

10 Claims, 8 Drawing Sheets

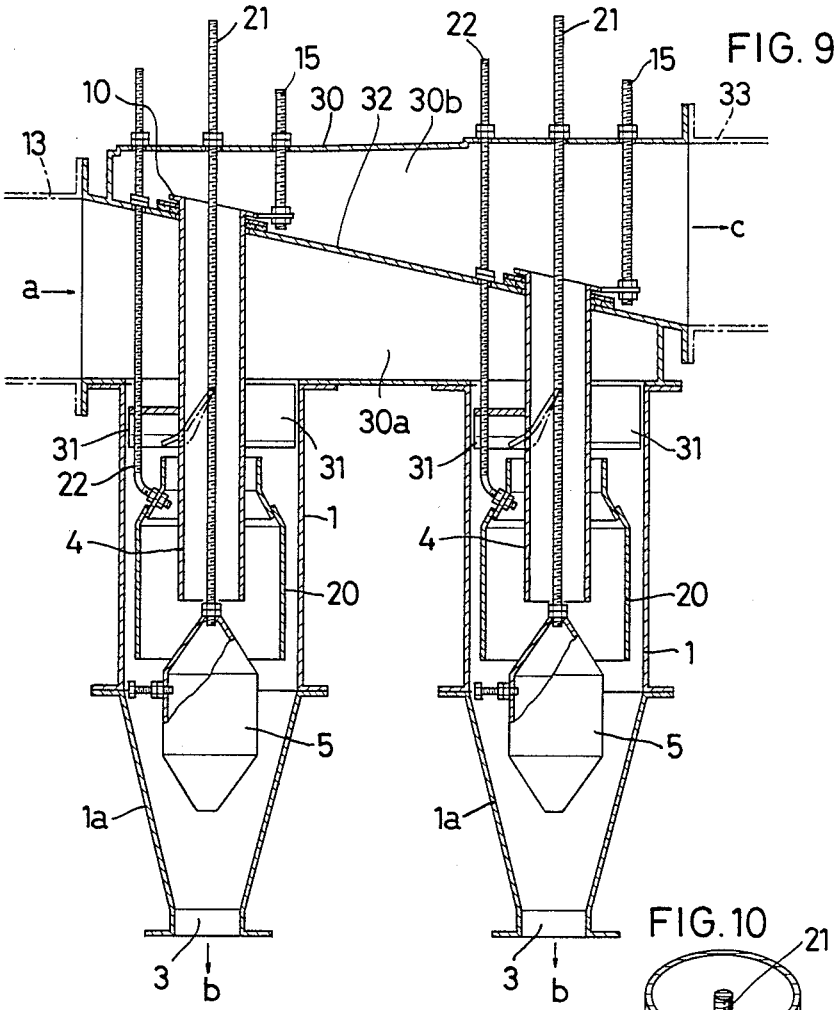
FIG. 9
FIG. 10
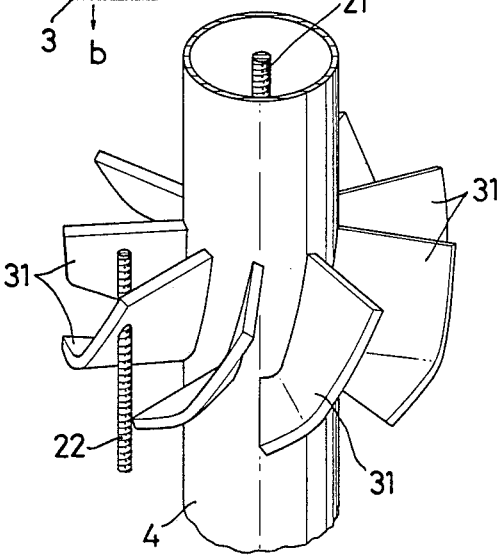

CYCLONE CLASSIFIER

This is a continuation of now abandoned application Ser. No. 051,373, filed May 19, 1987.

BACKGROUND OF THE INVENTION

The present invention relates to a cyclone classifier for separating solid particles from gas or liquid and classifying them according to the diameter and specific gravity of particles.

DESCRIPTION OF THE PRIOR ART

A conventional classifier of this type is shown in FIG. 14 which comprises a tubular or cylindrical casing 1, a discharge pipe 3 for solid particles connected to an opening at the lower end of a conical portion 1*a* of the cylindrical casing 1, a fluid outlet pipe 4 coaxially mounted in the casing 1 extending vertically through the upper surface of the casing into it, and a conic 5 having conical upper and lower ends and arranged between the lower end of the discharge pipe 3 and the opening of the conical portion 1*a*.

This type of classifier is adapted to introduce the material to be processed a into the casing 1 in a tangential direction through an inlet port 2, so that a swirling current is formed inside. The particles b having large diameter and high specific gravity are separated from the material a, when hitting the inner wall of the casing 1, under the influence of inertia force and centrifugal force, falling down the wall to be discharged through the discharge pipe 3. The remaining gas containing the particles with smaller diameter and low specific gravity is expelled through the outlet pipe 4.

One problem involved in this prior art apparatus is that the lower the incoming speed of fluid, the larger the diameter and specific gravity of particles classified are, i.e., the classifying point drops. If the speed of fluid flowing into the casing can be increased, the inertia force and centrifugal force would increase, so that the efficiency of classification would be improved.

Although higher incoming speed of fluid would allow not only large particles but particles having smaller diameter and specific gravity to be separated, thus increasing the classifying point, it would cause an increase in the pressure loss. The larger the pressure loss, the higher power is required for a fluid suction fan, thus incurring higher cost.

Further, with the abovesaid classifier, given that a swirling current tends to weaken at the lower part of the casing 1, smooth classification is hampered, thus making it difficult to achieve high efficiency of classification.

SUMMARY OF INVENTION

A major object of the present invention is to provide a classifier which provides a higher classification efficiency.

Another object of the present invention is to minimize the pressure loss while maintaining the classifying point at a high level.

From one aspect of the present invention, a tubular or cylindrical body is provided at a distance from the inner wall of the casing so as to extend downwardly from the level of the inlet port for the material to be processed.

From another aspect of the present invention, an annular pipe having fluid inlet ports is provided around the lower part of the tubular casing, the pipe being in communication with the casing all around their inner peripheries. This pipe functions for re-classification.

By the provision of the tubular or cylindrical body and the annular pipe, a higher classification efficiency is achieved. Also, the tubular or cylindrical body makes it possible to reduce the pressure loss while maintaining the classification point at a high level.

Other features and objects of the present invention will become apparent from the following description taken with reference to the accompanying drawing in which:

BRIEF DESCRIPTION OF THE DRAWINGS

FIGS. 1, 2, 5, 9, 11 and 13 are vertical sectional front views of various embodiments of cyclone classifiers in accordance with the present invention;

FIG. 10 is a perspective view of a vaned portion of the embodiment of FIG. 9;

DESCRIPTION OF THE PREFERRED EMBODIMENTS

EMBODIMENT 1

Figure 1:
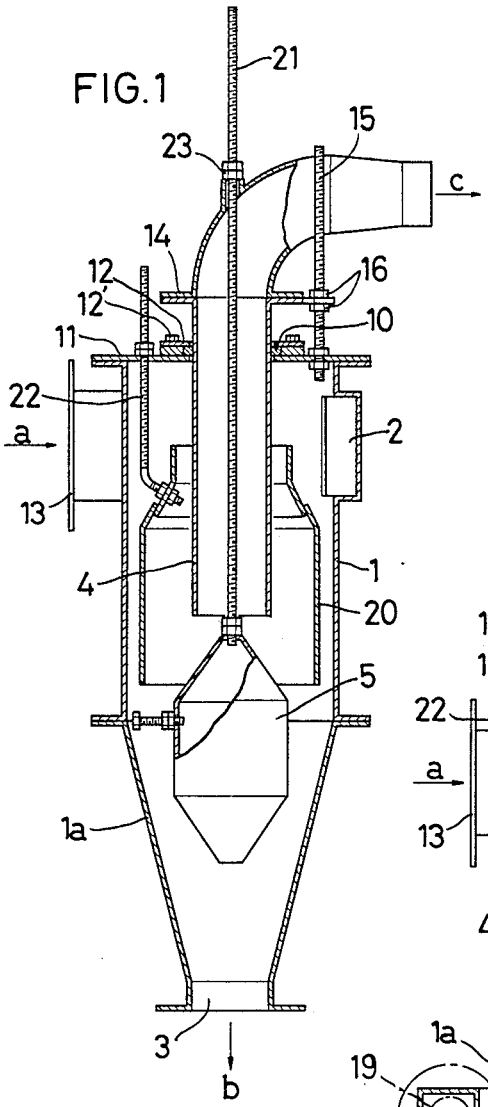

This embodiment is shown in FIG. 1, in which the vertical tubular or cylindrical casing 1 is provided with an upper plate 11 to close its upper opening. An outlet pipe 4 is vertically slidably mounted in the casing 1 so as to extend through a center hole of the upper plate 11 of the casing.

Around the center hole is provided a packing 10 which is pressed against the pipe 4 by an arm 12 and bolts 12' so as to keep air tightness even if the pipe 4 makes a sliding movement. The outlet pipe 4 is provided with a support plate 14, an arm of which is screwed on a threaded shaft 15 upwardly protruding from the upper plate 11 of the casing 1. The vertical position of the outlet pipe 4 is determined by controlling the height of point where it is fastened by nuts 16.

An inlet pipe 13 for the material to be processed a is tangentially connected to the upper part of the peripheral wall of the casing 1. The direction of its opening (inlet port 2) is along the tangential direction of the peripheral wall. When the material to be processed a is admitted into the casing 1, a swirling current is formed inside, and the particles b having larger diameter and specific gravity are separated when hitting the inner wall of the casing under centrifugal force and fall down the surface of the inner wall. The remaining gas c flows up into the lower end of the outlet pipe 4 and discharged through the pipe 4.

The lower part 1*a* of the casing 1 is of a conical shape. The conic 5, the upper and lower surfaces of which are conical in shape, is mounted between the opening of the conical portion 1*a* and the lower end of the outlet pipe 4. The cone 5 is coaxially mounted on a threaded shaft 21 which extends through the outlet pipe 4 and screwed into a bearing 23. The conic 5 is vertically movable with respect to the outlet pipe 4 by turning the shaft 21. The sectional area of the passage for the material to be processed between the conic 5 and the lower end of the outlet pipe 4 is adjustable by this vertical movement. The optimal sectional area is determined according to the kind, characteristics and specific gravity of the material to be processed and the required diameter of the particles separated.

A cylindrical or tubular body 20 which is one of features of the present invention is mounted above the conic 5 in the space between the inner wall of the casing 1 and the conic 5. The uppermost part of the cylindrical body 20 disposed near the inlet port 2 is straight with a small diameter. At the middle portion, the diameter becomes larger gradually. The lower part facing the upper conical part of the conic 5 is straight with a larger diameter. The cylindrical body 20 is fastened at its outer periphery to threaded shafts 22 at three points angularly spaced apart from each other. (FIG. 3) The shafts 22 are fastened to the upper plate 11 of the casing 1. The vertical position of the cylindrical body 20 can be adjusted by controlling the distance between two points at which the shaft is fastened to the tubular or cylindrical body and the upper plate. The optimal diameter, length and vertical position of the cylindrical body 20, and the distance between the inner wall of the casing 1 and the cylindrical body 20 can be determined based upon the kind and characteristics of the material to be processed a and the data obtained through experimental as well as practical operations.

In operation of this embodiment, with the gas sucked out of the casing through the outlet pipe 4, the material to be processed a flows through the inlet pipe 13 into the casing 1 between its inner wall and the cylindrical body 20, forming a swirling current. The particles b which are large in diameter and specific gravity hit on the inner wall of the casing 1 under the influence of centrifugal force and are separated there. Then they fall down the wall and are taken out of the casing 1 through the discharge pipe 3 continuously or discontinuously. The gas c containing particles having smaller diameter and specific gravity flows into the opening at the lower end of the outlet pipe 4 and discharged therethrough toward a collector means such as a bag filter.

Since the sectional area of passage for a swirling current is determined by the distance between the inner wall of the casing 1 and the cylindrical body 20, a decrease in the swirling speed as well as the pressure loss for a given degree of classification can be reduced compared with an apparatus with no cylindrical body. Even if the inner diameter of the casing 1 is rather large, the cylindrical body 20 will prevent particles from diffusing toward the center of the casing, thus decreasing the travel of particles to the inner wall of the casing. Accordingly, finer particles (with smaller diameter and specific gravity) can be more readily separated. In other words, the classifying point rises. In summary, the cylindrical body 20 serves to minimize the pressure loss while keeping high the classifying point.

EMBODIMENT 2

Figure 2:
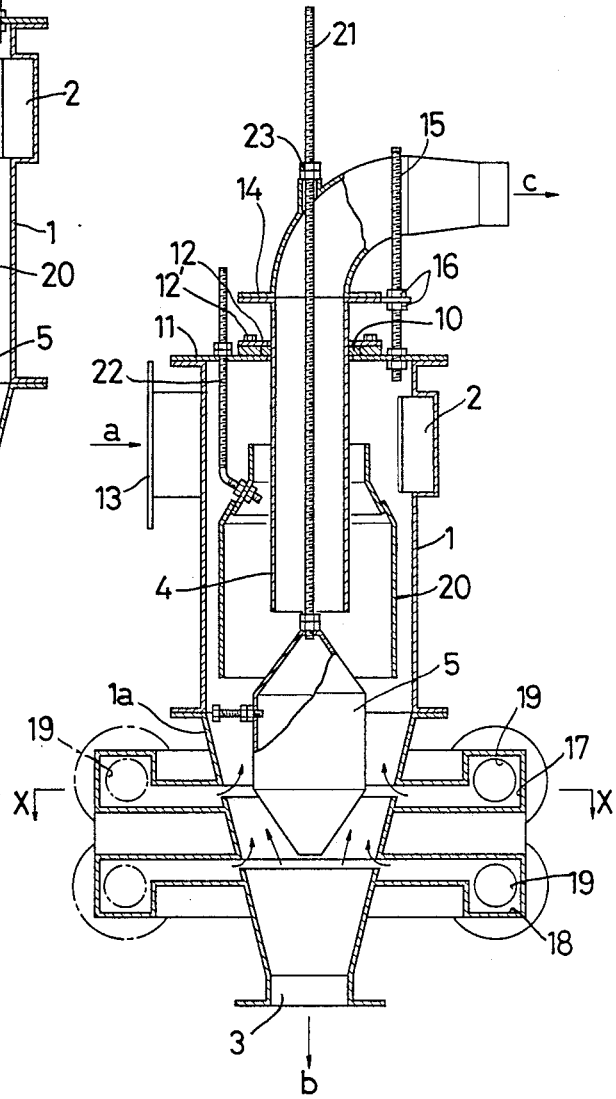
Figure 3:
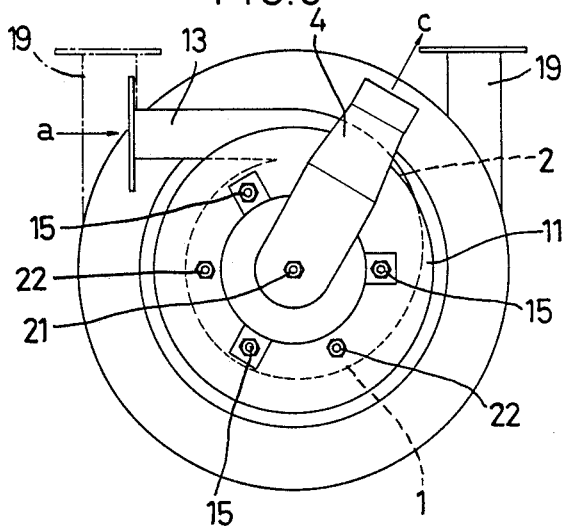
FIG. 3 is a plan view of the embodiment of FIG. 2.
Figure 4:
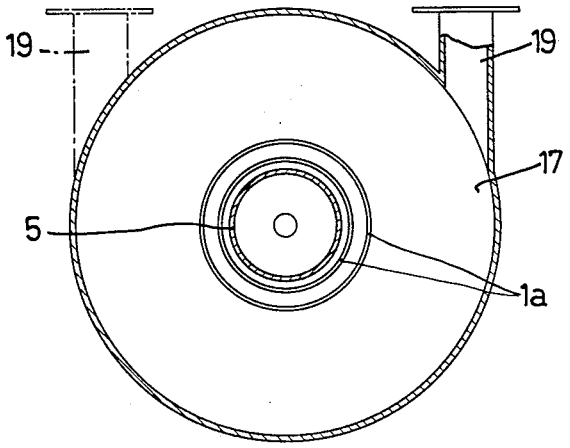
FIG. 4 is a sectional view taken along line X—X of FIG. 2.
Figure 5:
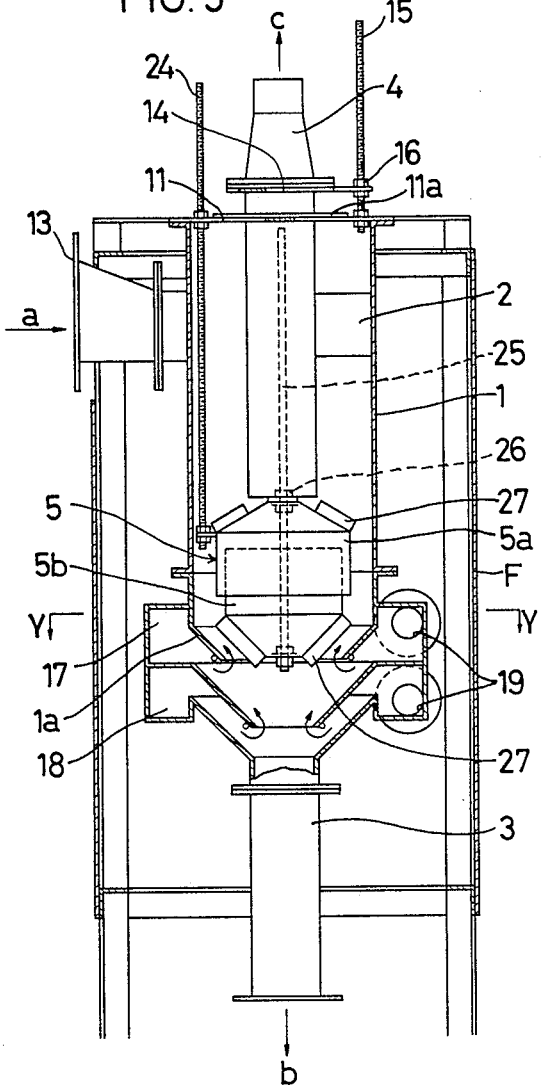
Figure 6:
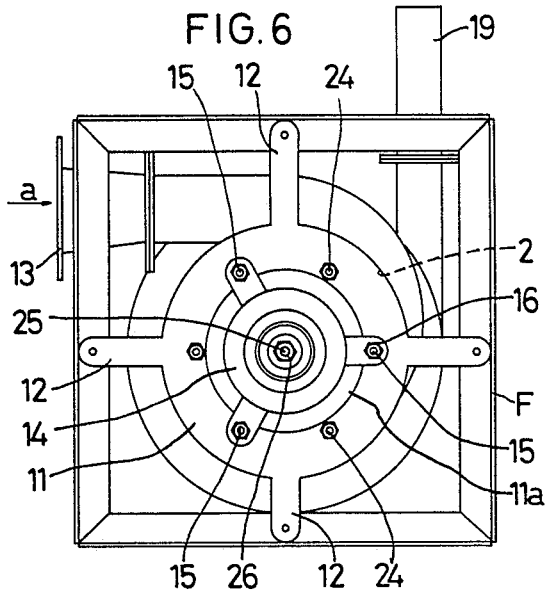
FIG. 6 is a plan view of the embodiment of FIG. 5.

This embodiment is shown in FIG. 2 through FIG. 4, in which annular air inlet passages 17 and 18 are provided on the outer periphery of the conical portion 1*a* at the lower part of the casing 1. This arrangement is another feature of the present invention. Inlet pipes 19 each connected to the upper and lower inlet passages 17 and 18 are so arranged that the incoming air will flow in the same tangential direction as the air flowing through the inlet port 2. The air flowing through the inlet pipes 19 is admitted into the casing 1 through the periphery of an opening or gas outlet port (see the four unnumbered curved arrows in FIG. 2 especially) of each inlet passages 17 and 18 to blow up the material to be processed a, forming a swirling current. The material is thereby reclassified to improve the efficiency of classification.

EMBODIMENT 3

This embodiment is shown in FIG. 5 through FIG. 8, in which the cylindrical body 20 employed in Embodiment 2 is not used, and the conic 5 and the blow-up openings of the air inlet passages 17 and 18 are modified.

In this embodiment, the casing 1 is arranged in a frame F and fixed thereto by means of arms 12 of the upper plate 11 of the casing 1. Each of the annular air inlet passages 17 and 18 is formed with a wall tapered downwardly and inwardly in the shape of an inverse cone with its inner periphery forming an opening. The air blown into the casing 1 through these openings is guided along the surface of the cone 5 outwardly toward the inner wall of the casing 1, flowing up the inner wall. This air current allows the material to be processed a located at the lower central portion of the casing 1 to be reclassified. The efficiency of classification is thereby improved.

The conic 5 consists of upper and lower cone members 5*a* and 5*b* nested with each other so as to be relatively movable in an axial direction. The upper cone member 5*a* is supported by threaded shafts 24 at three points angularly equally spaced from each other. The shafts 24 are further supported by the upper plate 11. The distance between two connections of each threaded shaft can be adjusted to set the upper cone member 5*a* in a desired position. The lower cone member 5*b* is supported by a threaded shaft 25 in the center of the outlet pipe 4. The shaft 25 extends through a bearing 26 arranged in the center of the upper cone member 5*a*. Turning the shaft 25 will move the lower cone member 5*b* up and down with respect to the upper cone member 5*a*.

Thus, the distance between the outlet pipe 4 and the conic 5 can be adjusted by changing the vertical position between the outlet pipe 4 and the upper cone member 5*a*. The distance between the conic 5 and the opening at bottom of the conical portion 1*a* is determined by adjusting the vertical position of the outlet pipe 4, the upper cone member 5*a*, and the lower cone member 5*b*.

Figure 7:
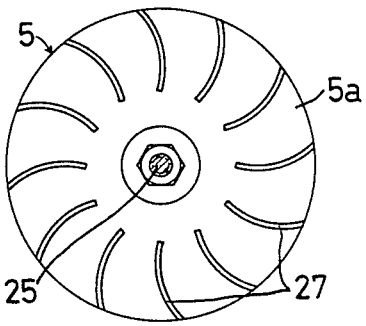
FIG. 7 is a plan view of the cone shown in FIG. 6.
Figure 8:
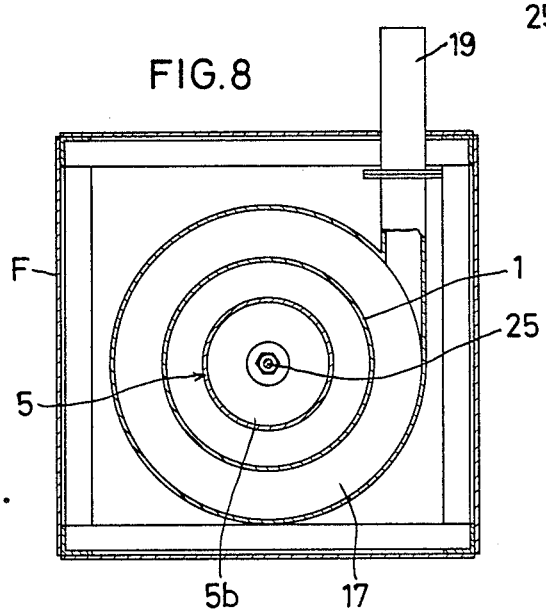
FIG. 8 is a horizontal sectional view taken along line Y—Y of FIG. 5.

As shown in FIG. 7, there are provided vanes 27 crooked inwardly, that is, in the direction of swirling of the material to be processed a (clockwise in FIG. 6) on the upper and lower surfaces of the upper and lower cone members 5*a* and 5*b*, respectively. These vanes 27 provide for a smooth flow of gas or liquid into the outlet pipe 4.

EMBODIMENT 4

In the abovesaid embodiments, the tangential inlet port 2 is formed in the peripheral wall of the casing 1, and through it the material to be processed a is admitted into the casing so that a swirling current will be formed inside. In this embodiment, the top of the casing 1 is open, through which the material to be processed a flows into the casing, and a swirling current is formed by means of vanes.

Namely, as shown in FIG. 9, two top-open casings 1 are mounted on the bottom of an airtight box 30 partitioned into upper and lower compartments. Each casing is provided with the cylindrical body 20 and the outlet pipe 4 which is slidably mounted through a partition wall 32 of the box 30, keeping airtightness. An inlet pipe 13 is connected to the lower compartment 30*a* of the box 30. An outlet pipe 33 leading to a collector is connected to the upper compartment 30*b*. Further, as shown in FIG. 10, a plurality of downwardly inclined vanes 31 are provided on the periphery of the outlet pipe 4 at the upper part of each casing 1.

In operating this apparatus provided with two casings 1 for classification, the air is firstly sucked out of the casings 1 through the outlet pipe 33 to draw the material to be processed a into the casings 1 through the inlet pipe 13 and the lower compartment 30*a* of the box 30. When the material to be processed a flows down along the vanes 31, a swirling current is formed owing to the inclination of the vanes. Thereafter, the material is classified in the same manner as the abovesaid embodiments.

EMBODIMENT 5

Figure 11:
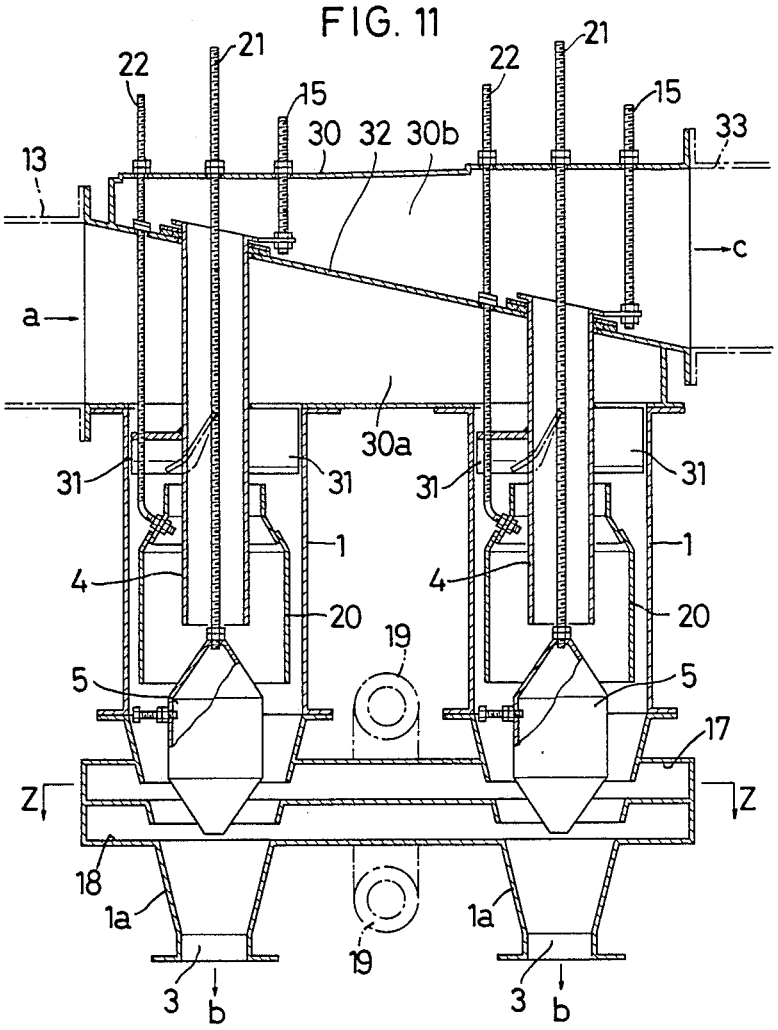
Figure 12:
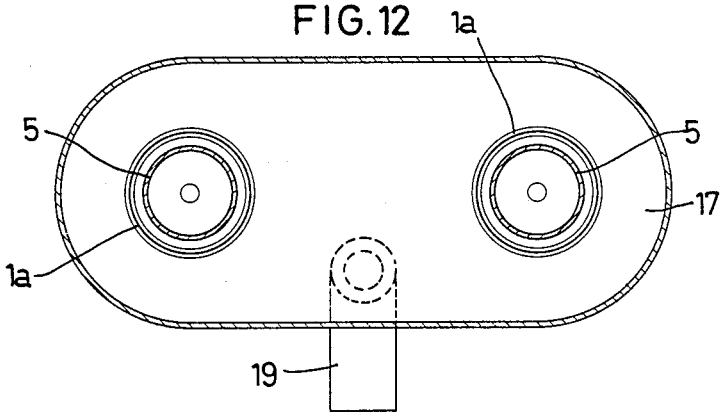
FIG. 12 is a sectional view taken along line Z—Z of FIG. 11.

In this embodiment, as shown in FIG. 11, at the lower part of the casings 1 (the same as in Embodiment 4) are provided air inlet passages 17 and 18 employed in Embodiments 2 and 3. Both air inlet passages 17 and 18 are used for both casings in common as shown in FIG. 12. The function and construction of the upper part of each casing 1 are the same as in Embodiment 4 and those of its lower part are the same as in Embodiment 2.

EMBODIMENT 6

Figure 13:
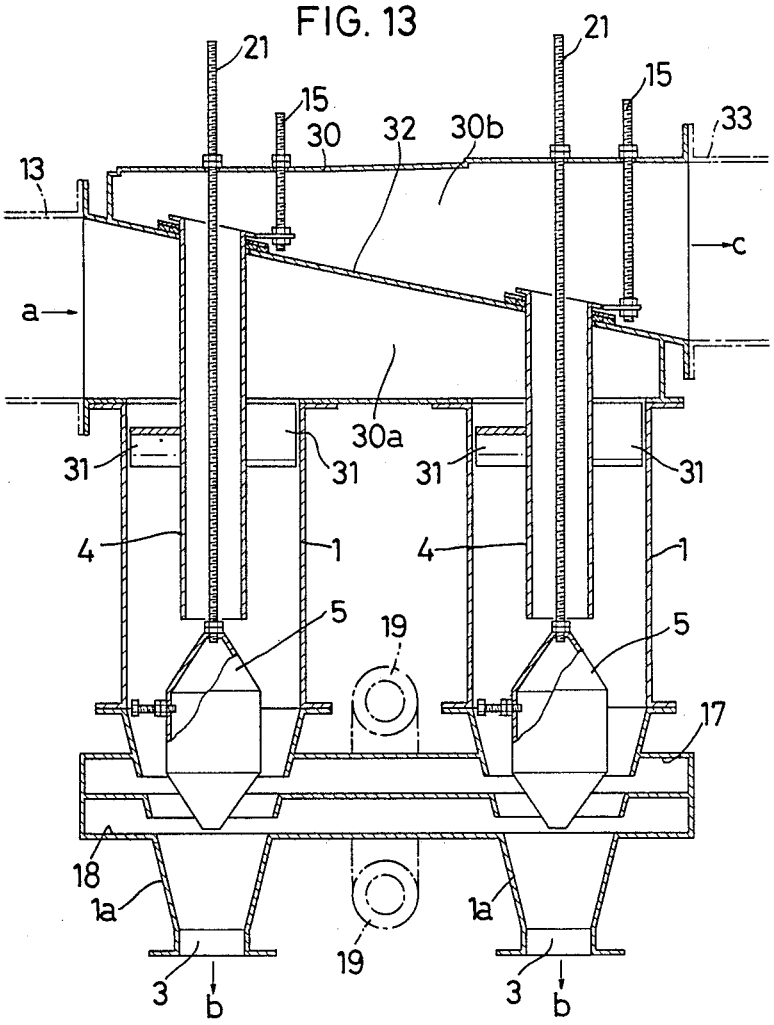
Figure 14:
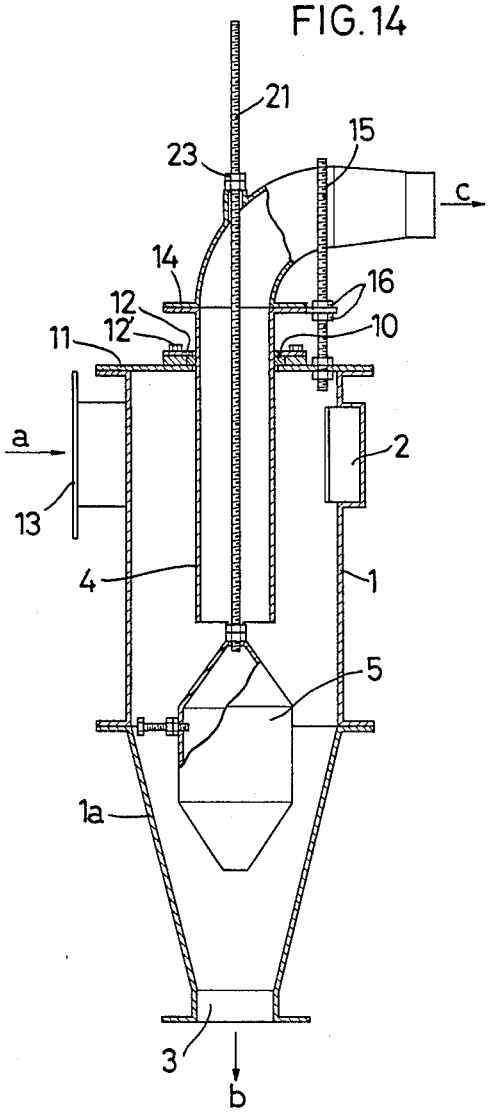
PRIOR ART FIG. 14
FIG. 14 is a vertical sectional front view of a prior art classifier.

As shown in FIG. 13, this embodiment is substantially the same as Embodiment 5 except that the cylindrical bodies 20 are not used. The function of the vanes 31 is the same as in Embodiment 4 and the function of the air inlet passages 17 and 18 is the same as in Embodiment 2.

In the description of the abovesaid embodiments, the material to be processed a is supposed to be gas. But liquid may naturally be processed in the same manner and with the same effect as described above.

Though in Embodiments 1, 2, 4 and 5, the cylindrical body 20 is arranged coaxially with the casing 1, the former may be arranged eccentrically with respect to the latter according to the kind and inflow speed of the material to be processed a and the position of the inlet port 2. For example, the cylindrical body may be arranged so that the distance between the cylindrical body 20 and the inner wall of the casing will be the longest at a point adjacent to the inlet port 2 and gradually decrease.

Further, as indicated by chain lines in FIGS. 3 and 4, the inlet pipe 19 leading to the air inlet passages 17 and 18 may be provided so that the direction of the flow in the pipe 19 is opposite to the direction of the flow through the inlet port 2. Two inlet pipes 19 shown by continuous and chain lines may be provided.

In Embodiments 4, 5 and 6, two casings are used. If three or more casings each having the features of the present invention are used, the effect of the invention will be further enhanced.

The vanes 31 may be mounted either on the casing 1 or on the cylindrical body 20. If they are mounted on the latter, it is preferable to further reduce the diameter of the upper reduced part of the cylindrical body 20 to such an extent that it touches the outlet pipe 4, and mount the vanes 31 on this portion.

What are claimed are:

1. A cyclone classifier comprising:

a tubular casing having upper, middle, and lower parts, said tubular casing including a peripheral wall defining an inside and an outside, and said lower part of said tubular casing including a substantially conical portion;

an inlet pipe means at said upper part of said tubular casing for supplying gas and material to be processed into the inside of said casing, said inlet pipe means having an inlet port means for directing the material to be processed into said casing and in a direction tangential to said peripheral wall of said casing;

a discharge pipe means for discharging solid particles and being at said lower part of said tubular casing;

an outlet pipe means for discharging gas and classified material from the inside or said tubular casing, said outlet pipe means extending from inside said casing, through said upper part of said casing, and outside said casing, said outlet pipe means having a first opening inside said casing and a second opening outside said casing;

a tubular body having upper, middle, and lower parts, said tubular body including a peripheral wall defining an inside and an outside, said lower part of said tubular body being open and surrounding and extending past said first opening of said outlet pipe means, and said peripheral wall of said tubular body being spaced from said peripheral wall of said tubular casing for defining a space for further directing the material to be processed directed by said inlet port means of said inlet pipe means in a direction tangential to said peripheral wall of said casing;

a conic being attached to said casing, located inside said casing, being spaced from said peripheral wall of said casing, being spaced from said tubular body, and being spaced from said first opening of said outlet pipe means, said conic having substantially conical upper and lower ends, and being located between said first opening of said outlet pipe means and said discharge pipe means; and an annular gas inlet pipe means substantially surrounding said peripheral wall of said lower part of said tubular Casing, said annular gas inlet means having an inner and an outer annular peripheral wall, a gas inlet port in said outer peripheral wall for introducing gas into said annular gas inlet pipe means in a direction tangential to said annular peripheral walls thereof for causing a smooth swirling tangential gas current there±n, a gas outlet port in said inner peripheral wall of said annular gas inlet pipe means, said gas outlet port extending around substantially the entire inner peripheral wall for fluidly communicating with said lower part of said tubular casing substantially around the entire circumference thereof for causing a smooth swirling tangential gas current in said tubular casing.

2. A cyclone classifier as in claim 1, wherein said upper part of said tubular casing is closed.

3. A cyclone classifier as in claim 1, further comprising a plurality of downwardly inclined vanes inside said tubular casing, located below said inlet port means, and being located around a central vertical axis of said tubular Casing.

4. A cyclone classifier as in claim 1, further comprising means for vertically adjusting said tubular body.

5. A cyclone classifier as in claim 1, further comprising means for vertically adjusting said conic.

6. A cyclone classifier comprising:

a tubular casing having upper, middle, and lower parts, said tubular casing including a peripheral wall defining an inside and an outside, and said lower part of said tubular casing including a substantially conical portion;

an inlet pipe means at said upper part of said tubular casing for supplying fluid and material to be processed into the inside of said casing, said inlet pipe means having an inlet port means for directing the material to be processed into said casing and in a direction tangential to said peripheral wall of said casing;

a discharge pipe means for discharging solid particles and being at said lower part of said tubular casing;

an outlet pipe means for discharging fluid and classified material from the inside of said tubular casing, said outlet pipe means extending from inside said casing, through said upper part of said casing, and outside said casing, said outlet pipe means having a first opening inside said casing and a second opening outside said casing;

a tubular body having upper, middle, and lower parts, said tubular body including a peripheral wall defining an inside and an outside, said lower part of said tubular body being open and surrounding and extending past said first opening of said outlet pipe means, and said peripheral wall of said tubular body being spaced from said peripheral wall of said tubular casing for defining a space for further directing the material to be processed directed by said inlet port means of said inlet pipe means in a direction tangential to said peripheral wall of said casing;

a conic being attached to said casing, located inside said casing, being spaced from said peripheral wall of said casing, being spaced from said tubular body, and being spaced from said first opening of said outlet pipe means, said conic having substantially conical upper and lower ends, and being located between said first opening of said outlet pipe means and said discharge pipe means; and means for vertically adjusting said tubular body.

7. A cyclone classifier as in claim 6, wherein said upper part of said tubular casing is closed.

8. A cyclone classifier as in claim 6, further comprising a plurality of downwardly inclined vanes inside said tubular casing, located below said inlet port means, and being located around a central vertical axis of said tubular casing.

9. A cyclone classifier as in claim 6, further comprising means for vertically adjusting said conic.

10. A cyclone classifier as in claim 6, further comprising a plurality of fluid inlet pipes at said lower part of said tubular casing and directing fluid into the inside of said tubular casing, said plurality of fluid inlet pipes having means for directing fluid in a direction tangential to said peripheral wall of said tubular casing for directing tangentially and upwardly fluid and material in said lower part of said tubular casing.

* * * * *